US010716987B1

(12) United States Patent
Baldwin

(10) Patent No.: US 10,716,987 B1
(45) Date of Patent: Jul. 21, 2020

(54) SPORT TRAINING DEVICE

(71) Applicant: Candace Baldwin, Anaheim, CA (US)

(72) Inventor: Candace Baldwin, Anaheim, CA (US)

( * ) Notice: Subject to any disclaimer, the term of this patent is extended or adjusted under 35 U.S.C. 154(b) by 0 days.

(21) Appl. No.: 15/944,108

(22) Filed: Apr. 3, 2018

(51) Int. Cl.
*A63B 69/00* (2006.01)
*A47L 23/26* (2006.01)

(52) U.S. Cl.
CPC ..... *A63B 69/0071* (2013.01); *A47L 23/266* (2013.01); *A63B 2243/0037* (2013.01)

(58) Field of Classification Search
CPC ..... A47L 23/266; A63B 69/3661
USPC ..... 473/278, 447
See application file for complete search history.

(56) References Cited

U.S. PATENT DOCUMENTS 3,234,577 A * 2/1966 Mann, Jr. ..... A47L 23/266 15/217
4,875,685 A * 10/1989 Ballinger ..... A63B 69/3661 473/262
6,635,331 B2 * 10/2003 Kessler ..... A47L 23/26 428/100
7,614,100 B1 * 11/2009 Barrington ..... A47G 9/062 383/4
8,287,395 B2 10/2012 Green
8,298,642 B2 * 10/2012 Yuan ..... A47G 27/025 428/45
2005/0096147 A1 * 5/2005 Schmidt ..... A63B 24/0003 473/278
2007/0219024 A1 * 9/2007 Allegre ..... A63B 69/002 473/422
2008/0187710 A1 * 8/2008 Stanchfield ..... A47G 23/03 428/99
2010/0304880 A1 * 12/2010 Li ..... A63B 69/3661 473/278
2011/0229692 A1 * 9/2011 Bozouklian ..... A47L 23/266 428/156
2012/0178546 A1 * 7/2012 Park ..... A63B 69/3661 473/278
2016/0037949 A1 * 2/2016 Dawson ..... A47G 27/0206 428/95
2017/0037568 A1 * 2/2017 Love ..... A47L 23/266
2018/0042420 A1 * 2/2018 Johnson ..... A47G 27/0231
2018/0093160 A1 * 4/2018 Alhadeff ..... A63B 71/0622

* cited by examiner

*Primary Examiner* — Laura Davison
(74) *Attorney, Agent, or Firm* — Sanchelima & Associates, P.A.; Christian Sanchelima, Esq.; Jesus Sanchelima, Esq.

(57) ABSTRACT

The present invention provides a training device with replaceable surface environments for practicing basketball dribbling. The training device includes a platform, having a frame and base, and a mat removably disposed on the base. The mats are available with varieties of different surface environments. In particular, the platform provides two pockets formed on two opposing sides with respect to the base and two different varieties of mats can be inserted therein, such that the training device offer different surface environments when reversed. The training device is foldable and further the mats can be rolled, making the training device portable to carry.

11 Claims, 11 Drawing Sheets

SPORT TRAINING DEVICE

BACKGROUND OF THE INVENTION

1. Field of the Invention

The present disclosure generally relates to a training device; and more particularly to a training device with replaceable environments for practicing basketball dribbling.

2. Description of the Related Art

In basketball, dribbling consists of bouncing the ball on the floor repeatedly with one hand while walking or running down the court. Dribbling and controlling the ball is a skill that can be practiced alone and is separate from the other ball skills on the court. Fundamentally, dribbling practice in general involves repetitively bouncing the ball on a surface over and over again, until such movements become second nature. Athletes ranging from professional level down to the casual athlete can improve their basketball playing skills via the use of such fundamental dribbling practice. Moreover, practicing dribbling in itself can be a great exercise, as it involves lot of muscular activities.

It is to be noted that every basketball court does not shares the same type of playing surface. Professional and amateur leagues usually maintain their own regulations towards use of different types of surfaces for different types of basketball games. For example, most professional and collegiate basketball games are played on hardwood basketball courts. Hard surfaces, using concrete or asphalt types materials, are typically used for outdoor basketball courts. Community parks use these materials for their basketball courts due to their strength and durability as well as the ability to withstand harsh weather conditions. On the other hand, various gyms and local indoor tournaments use carpet or artificial turfs in their basketball courts.

These different types of court's surfaces provide different levels of bounce and consistency. For example, the hardwood court has a usually smooth surface, and provides a consistent bounce. Concrete courts, on the other hand, due to their uneven surface provide inconsistent bounce. Carpet or grass type courts requires more force on part of a person to achieve a proper bounce. Thus, it may be understood that for the person to become familiar with playing on different surfaces, he/she may need to practice his/her dribbling skills on many different types of surfaces. However, it may not be feasible for every person to get access to each type of basketball courts.

Some sports training devices are known which provide different types of surfaces for practicing varying skills. Applicant believes that a related reference corresponds to U.S. Pat. No. 8,287,395A (hereinafter referred to as '395 patent) which relates to a golf training apparatus that includes one or more components, such as a chipping mat, a putting mat, among others. Herein, the chipping mat may include a plurality of sections of artificial turf, each simulating a different type of grass found on a golf course, such as the fairway, rough, and deep rough; whereas the putting mat has sections with varying geometric shapes. It may be understood that the training apparatus of the '395 patent is specifically designed for practicing golf and thus may not be suitably implemented for training for other sports, such as basketball. Further, in the training apparatus of the '395 patent, the various sections with different surfaces are fixed to the underlying mat and are not replaceable as per training need of the player.

Other documents describing the closest subject matter provide for a number of more or less complicated features that fail to solve the problem in a convenient and efficient manner. None of these documents suggest the novel features of the present invention.

SUMMARY OF THE INVENTION

It is one of the main objectives of the present invention to provide a training device with allows for changing surfaces for providing varying training environments.

It is another objective of the present invention to provide a training device in which changing surfaces shall be fast and convenient, and not cumbersome.

It is yet another objective of the present invention a training device which is portable and inexpensive to manufacture.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Illustrative embodiments of the present invention are described below. The following explanation provides specific details for a thorough understanding of and enabling description for these embodiments. One skilled in the art will understand that the invention may be practiced without such details. In some instances, well-known structures, processes and functions have not been shown or described in detail to avoid unnecessarily obscuring the description of the embodiments.

It shall be noted that unless the context clearly requires otherwise, throughout the description, the words "comprise," "comprising," "include," "including," and the like are to be construed in an inclusive sense as opposed to an exclusive or exhaustive sense; that is to say, in the sense of "including, but not limited to." Words using the singular or plural number also include the plural or singular number, respectively while adhering to the concepts of the present invention. Furthermore, references to "one embodiment" and "an embodiment" are not intended to be interpreted as excluding the existence of additional embodiments that also incorporate the recited features.

Figure 1:
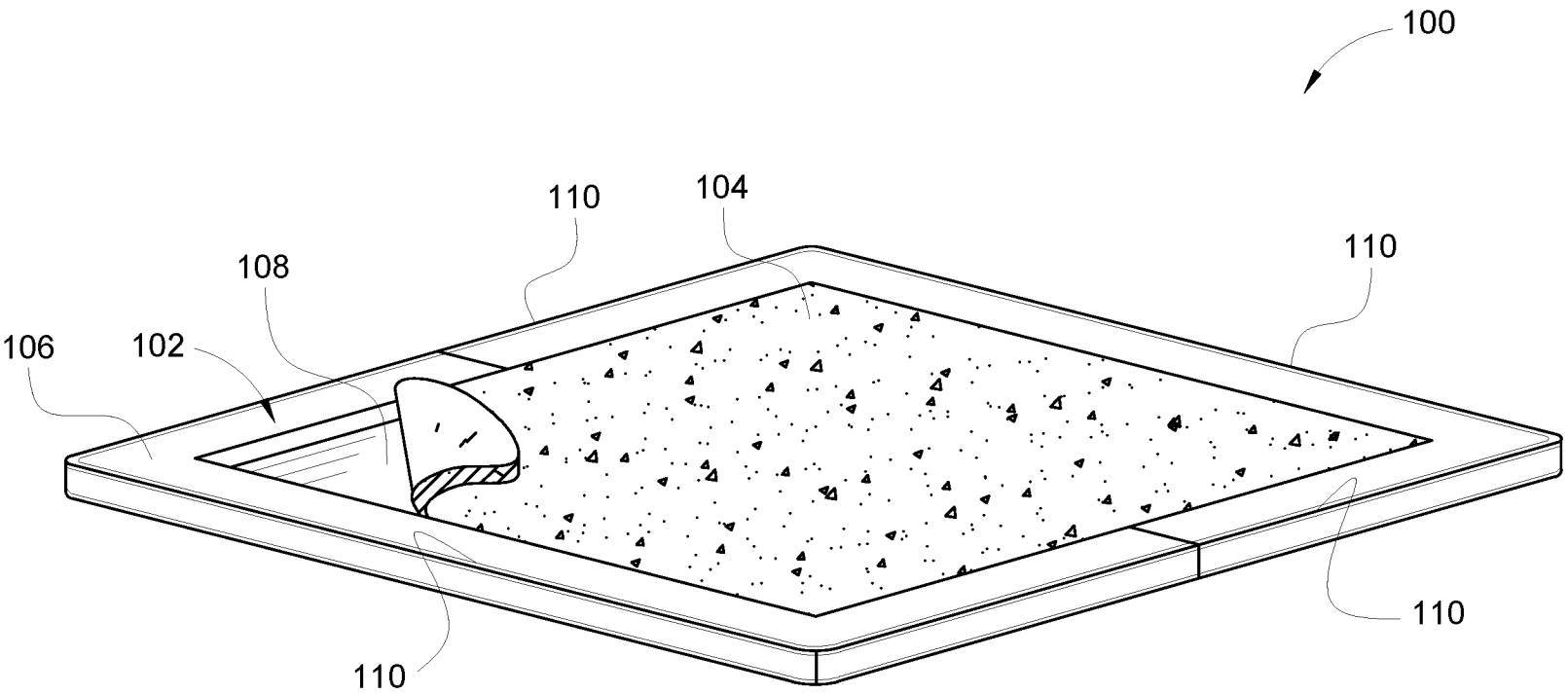
FIG. 1 illustrates a perspective view of a training device, in accordance with one or more embodiments of the present disclosure.
Figure 2:
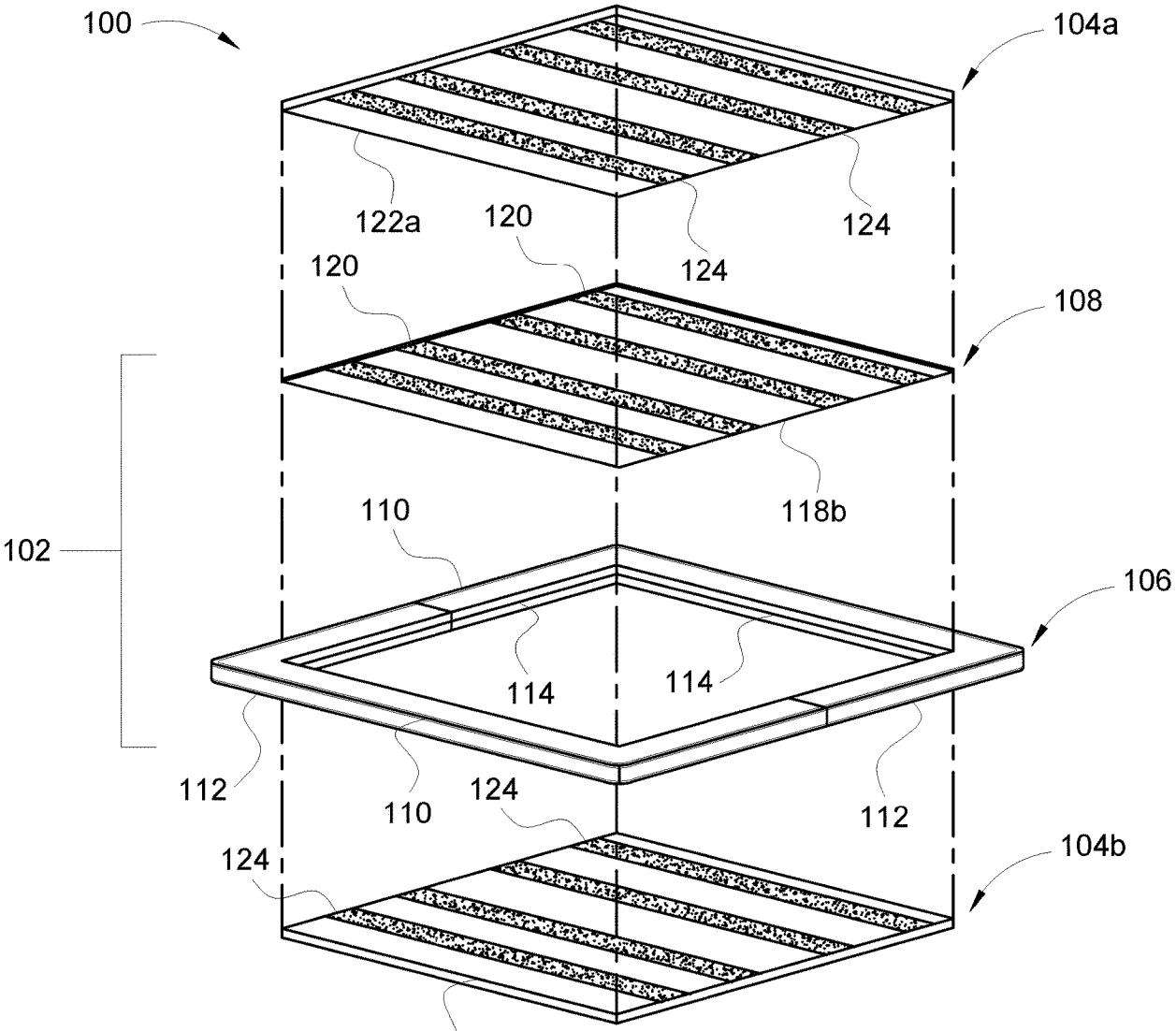
FIG. 2 illustrates an exploded view of the training device of FIG. 1, in accordance with one or more embodiments of the present disclosure.

Referring to the drawings, FIG. 1 illustrates a diagrammatic perspective view of a training device (hereinafter referred to by the numeral 100), in accordance with an embodiment of the present disclosure. FIG. 2 illustrates a diagrammatic exploded view of the training device 100. As illustrated in FIGS. 1-2, the training device 100 includes a platform 102 and a mat 104 inserted therein. Specifically, the platform 102 includes a frame 106 and a base 108 fixed within the frame 106, and the mat 104 is removably disposed on the base 108. In FIG. 1, for illustration purposes, the mat 104 is shown to be slightly removed from an edge thereof, in order to show the base 108 underneath. Further, it may be seen that the mat 104 is disposed within the inner peripheral region of the frame 106 (as will be discussion later in detail).

Figure 3:
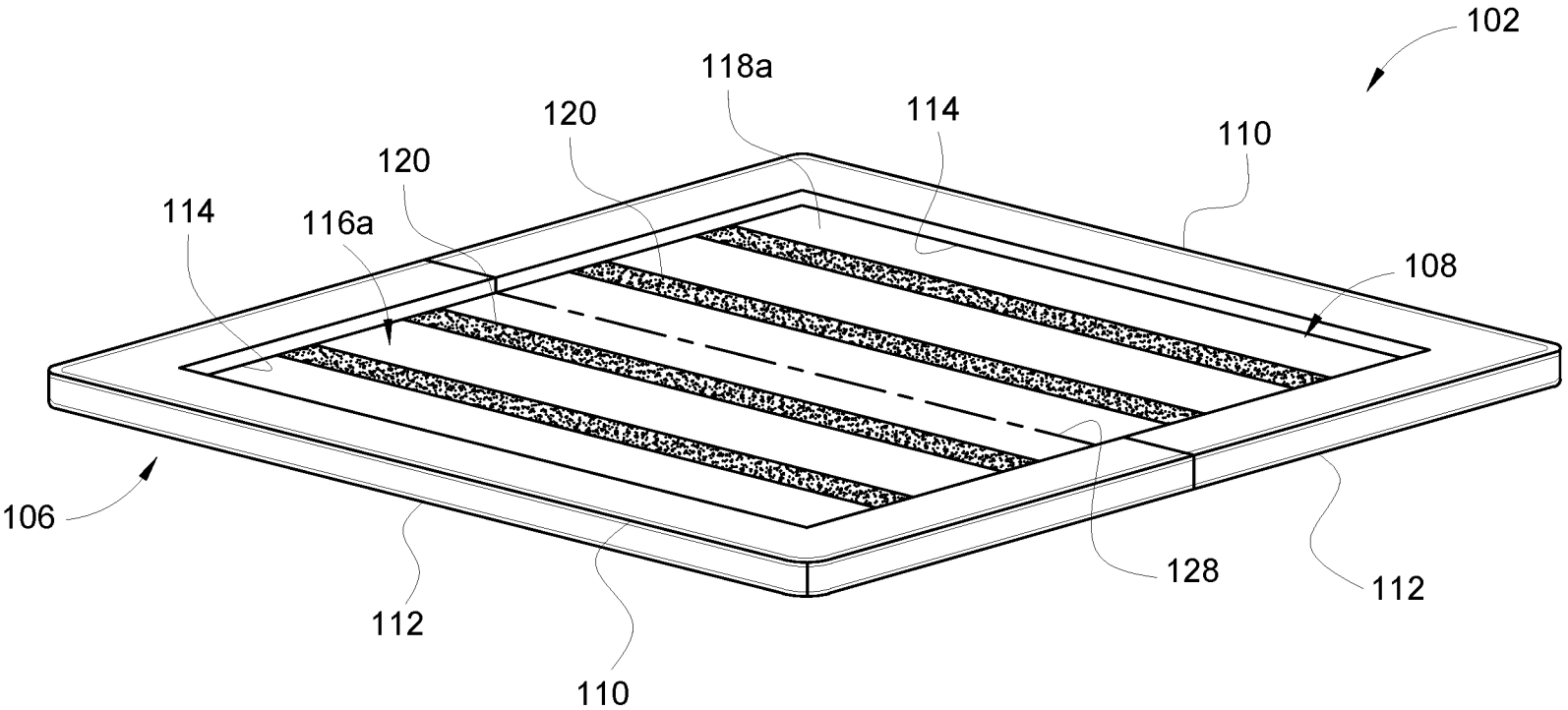
FIG. 3 illustrates a perspective view of a platform of the training device, in accordance with one or more embodiments of the present disclosure.
Figure 4:
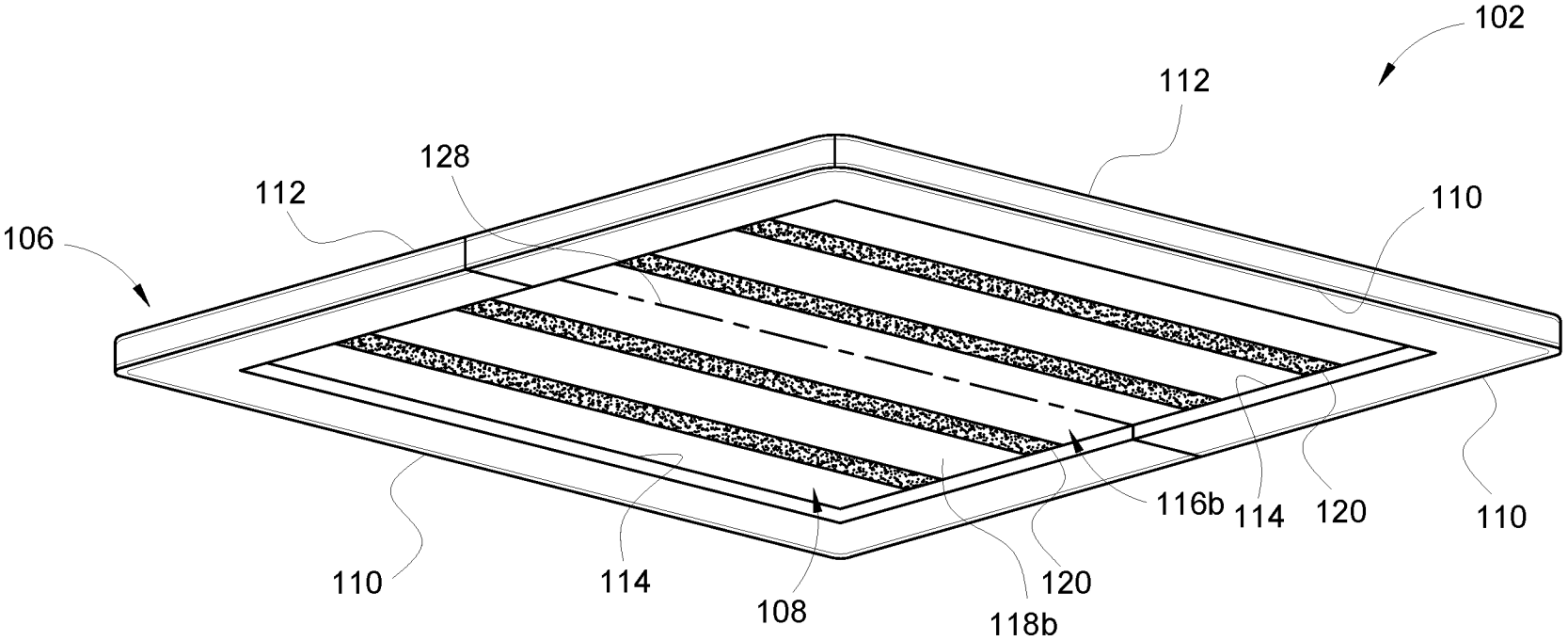
FIG. 4 illustrates a perspective view of a platform reversed from FIG. 3, in accordance with one or more embodiments of the present disclosure.

FIGS. 3-4 illustrate diagrammatic perspective views of the platform 102, in accordance with an embodiment of the present disclosure. As noted earlier, the platform 102 includes the frame 106, and the base 108 is fixed within the frame 106. In an embodiment, the frame 106 is generally of a square or rectangular shape with four sides 110. In one example, the frame 106 may be formed of multiple elongated members which are joined together along their ends to complete the structure thereof. For instance, the frame 106 may be formed of four equal length members (which forms the sides 110 later) joined together to impart the frame 106 a generally square shape. In other examples, the frame 106 may be manufactured by casting or forging a single square-shaped structure, or the like. In some alternate examples, the frame 106 may have a generally circular shape or any other suitable shape without any limitations. In some examples, the frame 106 may generally be constructed of plastic, such as PVC, or similar materials. Such material may be preferred because of being light-weight and strong for regular while having properties to be formed easily into desired shapes. In other examples, the frame 106 may be made of softer materials, such as, but not limited to, rubber. Further, the base 108 may be made of hard material, such as, but not limited to, plywood, plastic, or the like. It may be contemplated that the base 108 may be fixed to the frame 106 by any suitable fastening means, to complete the platform 102.

In an exemplary embodiment, the sides 110 of the frame 106 may have beveled outer edges 112 and straight inner edges 114. Further, in some examples, the corners of the frame 106 may be curved. When the training device 100 may be placed on the ground, it may be contemplated that the sides 110 of the frame 106 would stay flushed with the ground. Further, the beveled outer edges 112 may aid with preventing any injuries in case a person may accidently hit any of the sides 110 of the training device 100 lying around on the ground. It may be contemplated that the dimensions of the frame 106 defines the dimension of the overall structure of the training device 100. In one example, the frame 106 may have a square shape with dimensions of about 4 feet by 4 feet; or in other words, each of the sides 100 may have a length of about 4 feet. In other examples, the frame 106 may have a rectangular shape with dimensions of about 6 feet by 4 feet. Further, in one example, the frame 106 may have a height ranging from about 1 to 4 inches above the ground; which, in turn, also implies that the inner edges 114 of the sides 110 have the height of about 1 to 2 inches. It shall be appreciated that the provided dimensions are exemplary only and may vary with affecting the scope of the present disclosure in any manner.

It may be contemplated that FIG. 4 illustrates a reverse view of the platform 102 with respect to FIG. 3. As may be seen, the platform 102 is similar in design and configuration from its top side and bottom side. Referring to FIG. 3 and FIG. 4 in combination, it may be seen that the base 108 is circumscribed within the frame 106. Specifically, the base 108 may be disposed in contact with the inner edges 114 of the frame 106 along all sides thereof. It may be seen that the base 108 may generally be in the form of a flat sheet fixed within the inner edges 114 of the frame 106. In one embodiment of the present disclosure, the base 108 may be disposed substantially about a geometric center line about the height of the inner edge 114 of the frame 106. For example, assuming the height of the inner edge 114 being about 2-inches; in such case, the base 108 may be located at about 1-inch mark about the center of the inner edge 114. It may be contemplated by a person skilled in the art that such arrangement may form two pockets 116*a*, 116*b* along two opposing sides of the platform 102. That is, the platform 102 when placed on the ground may have one pocket 116*a* formed along one side (e.g., top side) exposing a first surface 118*a* of the base 108; and when the same platform 102 is reversed/inverted on the ground, the platform 102 may have another pocket 116*b* formed along other side (e.g., bottom side) thereof exposing a second surface 118*b* of the base 108.

Further, in an embodiment, the base 108 may include a plurality of fastening members 120 to allow the mat 104 to be removable fixed thereto (as will be discussed later in detail). In one example, the fastening members 120 may be in the form of Velcro™ strips laid parallel along the length of the base 108. Generally, the fastening members 120 may be permanently attached to the surfaces 118*a*, 118*b* of the base 108, in the platform 102. Specifically, as illustrated in FIGS. 3-4, the fastening members 120 may be arranged on both the opposing surfaces 118*a*, 118*b* of the base 108. In the illustrated example, each of the surface 118*a*, 118*b* is shown to include a total of four such fastening members 120 arranged thereon. It shall be appreciated that the number of such straps of the fastening members 120 are exemplary only. As best shown in FIG. 2, there may exist horizontal spaces between fastening members 120.

Figure 5:
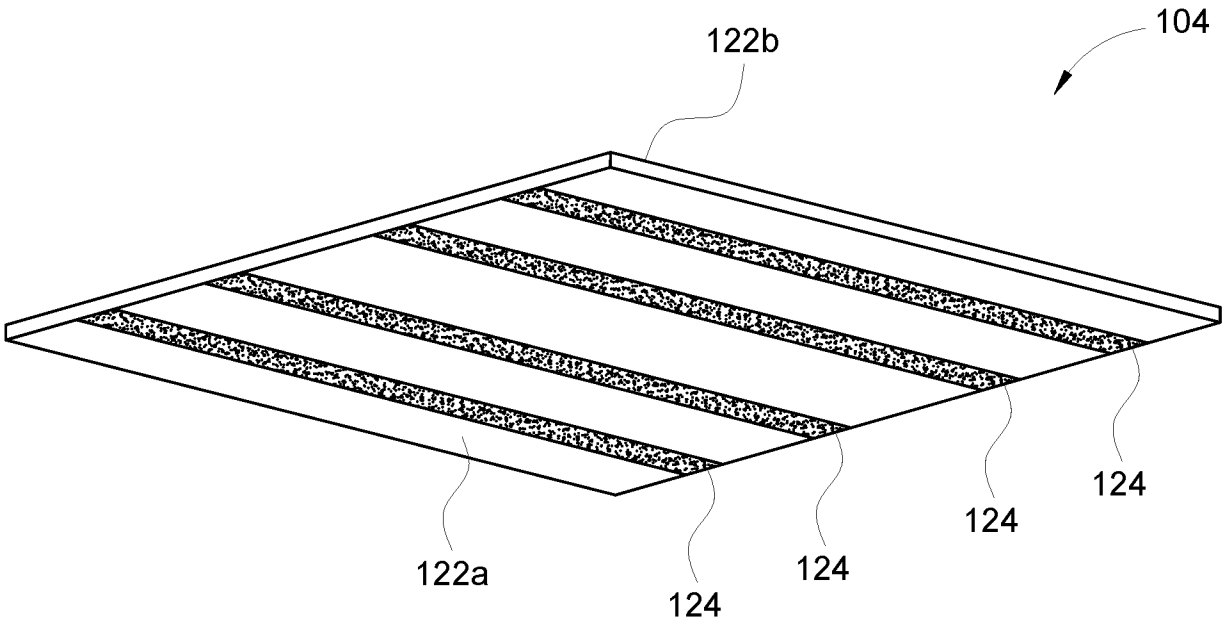
FIG. 5 illustrates a bottom perspective view of a mat used in the training device, in accordance with one or more embodiments of the present disclosure.
Figure 6:
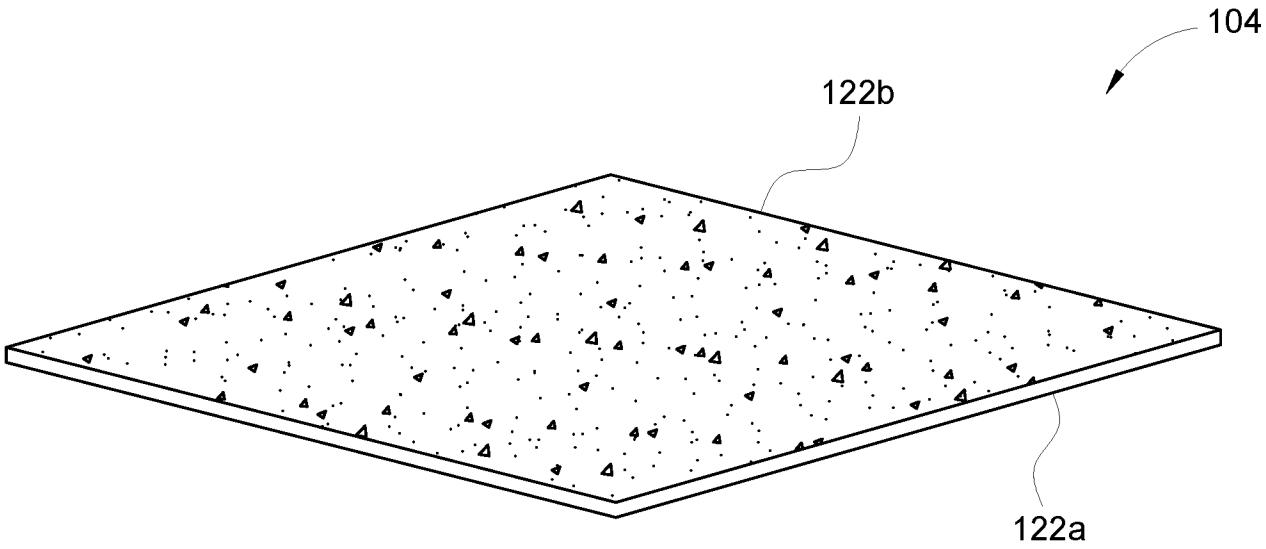
FIG. 6 illustrates a top perspective view of the mat, in accordance with one or more embodiments of the present disclosure.

FIG. 5 illustrates perspective view of the mat 104 showing a bottom face 122*a* thereof; and FIG. 6 illustrates perspective view of the mat 104 showing a top face 122*b* thereof, in accordance with an embodiment of the present disclosure. In an embodiment, the bottom face 122*a* of the mat 104 includes a plurality of fastening members 124 to allow the mat 104 to be removable fixed to either one of the surfaces 118*a*, 118*b* of the base 108, in the training device 100. In one example, the fastening members 124 may be permanently attached to the bottom face 122*a* of the mat 104. In the present example, the fastening members 124 may also be in the form of Velcro™ strips laid parallel along the length of the mat 104. It may be understood that the arrangement of the plurality the fastening members 124 in the bottom face 122*a* of the mat 104 shall be substantially similar to the arrangement of the plurality the fastening members 120 in the corresponding surface 118*a* or 118*b* of the base 108, to allow for the mat 104 to be removable fixed to the base 108. As best shown in FIG. 2, there may exist horizontal spaces between fastening members 124.

In an embodiment, the training device 100 of the present disclosure may be implemented as a basketball dribbling practicing equipment where a user might place the training device 100 on the ground and use the mat 104, or specifically the top face 122*b* of the mat 104, as floor for bouncing a ball thereon. As noted earlier, the user may desire to use different surface types as the top face 122*b* of the mat 104 for practicing varying skills. The present training device 100 is adapted to provide different varieties of mats 104 having different types of top faces 122*b* therein, such that the player may choose to replace a current mat 104 with a different mat 104 when required to change the practicing surface. As exemplarily depicted in FIG. 6, it may be understood that the different varieties of mats 104 comes with different types of top faces 122*b*, in which the top face 122*b* provides a texture and firmness based on the requirements of the training device 100. In the present examples, different varieties of the mats 104 may provide the top faces 122*b* such as, but not limited to, carpet type (e.g., low carpet and high carpet), turf type (e.g., low grass, high grass and thick grass), hardwood floor type, gym pad type, etc. Thus, the training device 100 of the present disclosure may offer the user an option to use different types of practicing surfaces, for example, for practicing his/her dribbling skills with respect to various basketball court's environments.

Referring back to FIG. 2, it may be seen that the training device 100 may accommodate two mats 104 inside the two pockets, i.e. a first mat 104*a* in the pocket 116*a* on one side of the platform 102 and another mat 104*b* in the pocket 116*b* on reverse side of the platform 102. As shown, the mats 104*a*, 104*b* may generally in the form of a flat sheet of some thickness. It may be contemplated that the first mat 104*a* may be removably disposed on the surface 118*a* of the base 108 and the second mat 104*b* might simultaneously be removably disposed on the surface 118*b* of the base 108. Further, the user if desires may simply flip the training device 100 to switch from mat 104*a* with one type of surface characteristics to mat 104*b* with some other type of surface characteristics.

Figure 7:
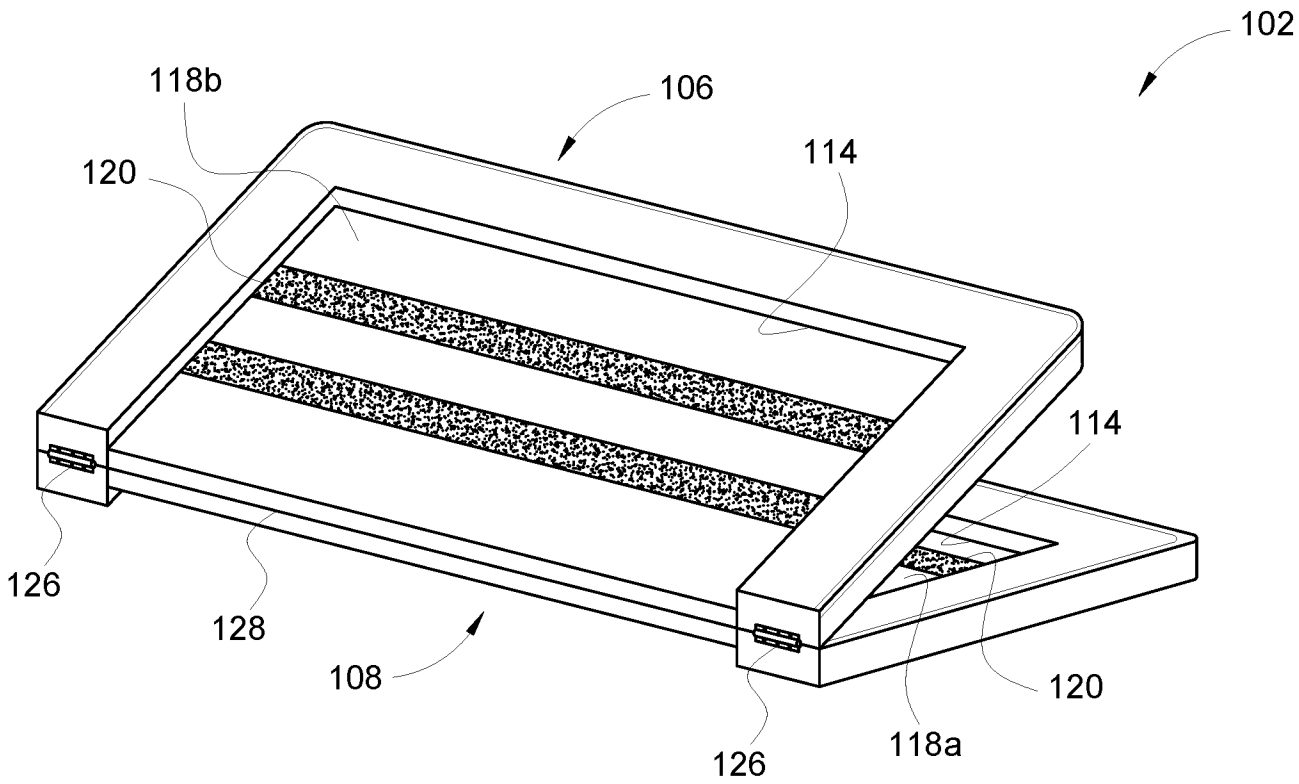
FIG. 7 illustrates a rear perspective view of the platform being implemented in a folded position, in accordance with one or more embodiments of the present disclosure.
Figure 8:
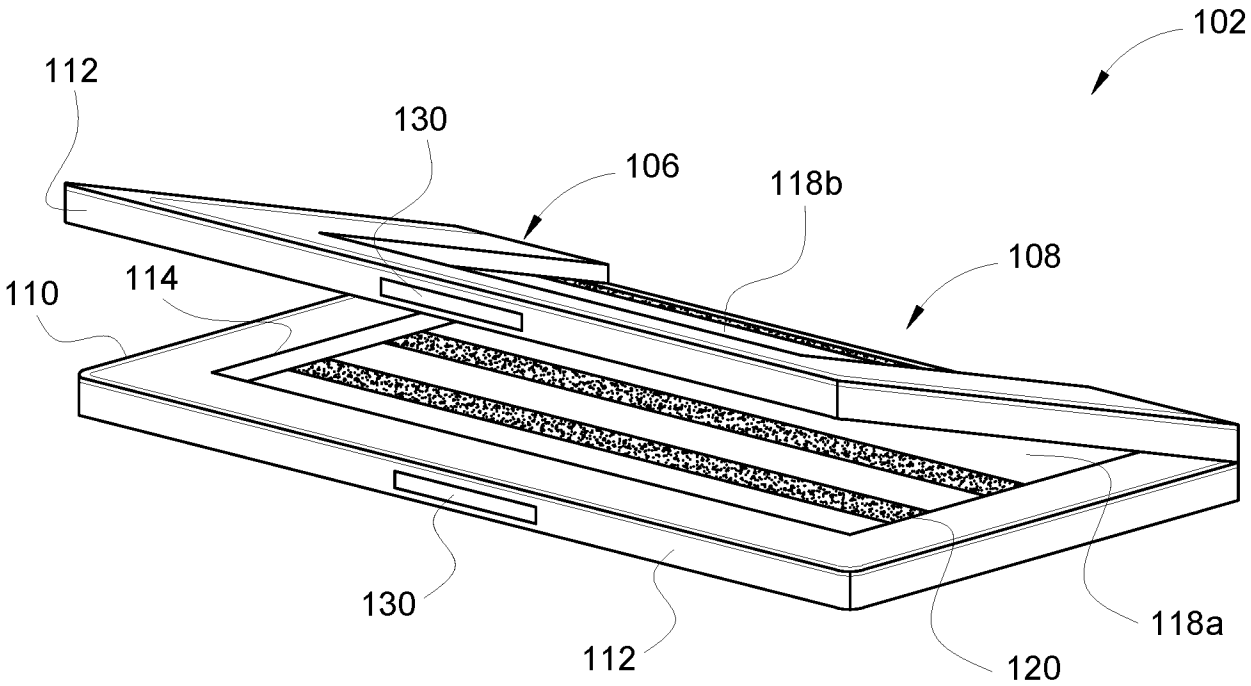
FIG. 8 illustrates a front perspective view of the platform being implemented in a folded position, in accordance with one or more embodiments of the present disclosure.

In some embodiments of the present disclosure, the platform 102 has a foldable configuration. FIG. 7 illustrates a rear perspective view of the platform 102 showing the platform 102 being implemented into a folded position, in accordance with an embodiment of the present disclosure. FIG. 8 illustrates a front perspective view of the platform 102 showing the platform 102 being implemented into the folded position. For this purpose, the platform 102 may include a hinge mechanism 126 provided on the side 110 along at least one of the top or the bottom thereof. In particular, as illustrated in FIG. 7, the hinge mechanism 126 may be disposed at about a center of the two opposing sides 110 of the frame 106. It may be understood that in order to allow the platform 102 to fold in half about the hinge mechanism 126, the base 108 may also be foldable about a center thereof, shown by means of a seam 128 formed in the base 108 and further depicted in FIGS. 2-4.

Figure 9:
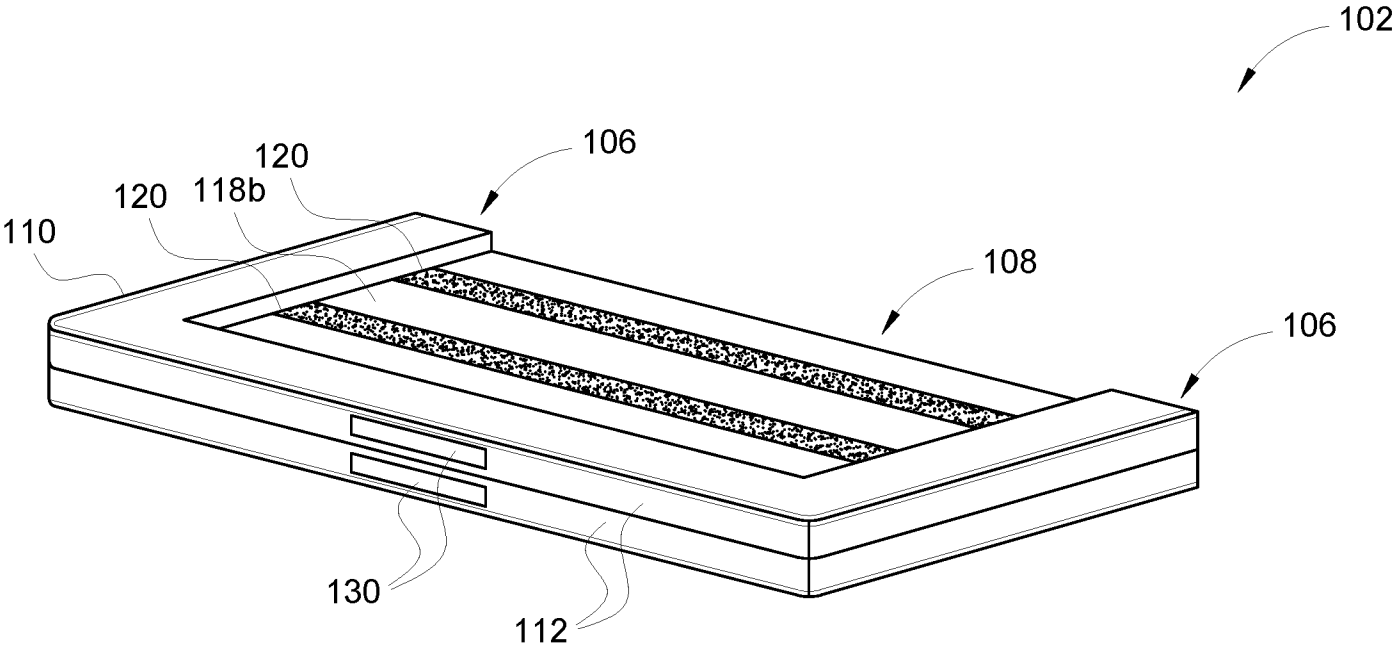
FIG. 9 illustrates a front perspective view of the platform in folded position, in accordance with one or more embodiments of the present disclosure.

FIG. 9 illustrates the platform 102 implemented into the folded position, in accordance with an embodiment of the present disclosure. As illustrated in FIG. 9, the platform 102 may include handles 130 formed on the outer edges 112 of two opposing sides 110 of the frame 106. The handles 130 may allow to lift one half of the platform 102 about the hinge mechanism 126 in order to transform the platform 102 from the folded position to an open position (as depicted in FIGS. 3-4), and vice-versa. In the present examples, the handles 130 are shown in the form of grooves formed in the outer edges 112 of the sides 110. It shall be appreciated that the handles 130 may be of any other suitable design and form, such as knobs, levers, etc.; and the shown grooved design thereof shall not be construed as limiting to the present disclosure.

Figure 10:
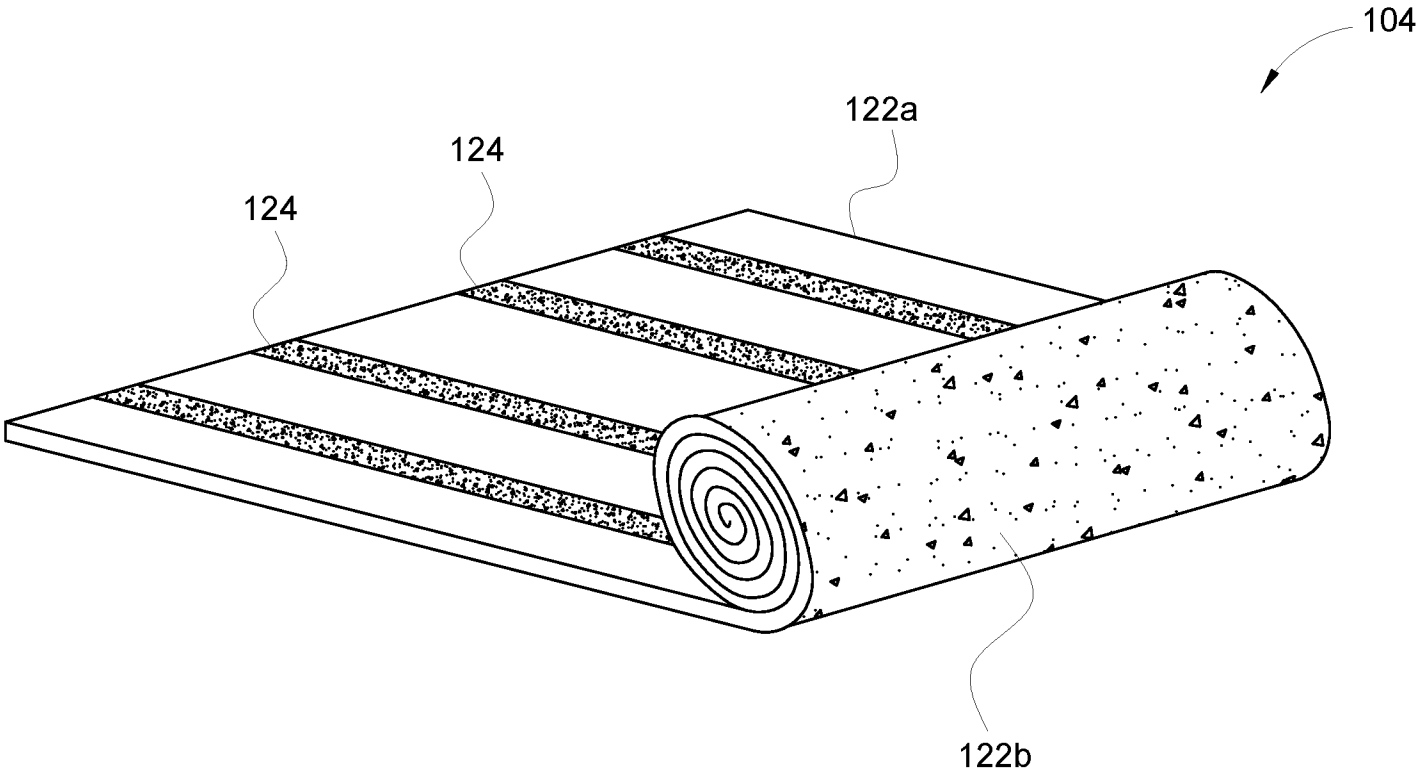
FIG. 10 illustrates a perspective view of the mat being rolled, in accordance with one or more embodiments of the present disclosure.
Figure 11:
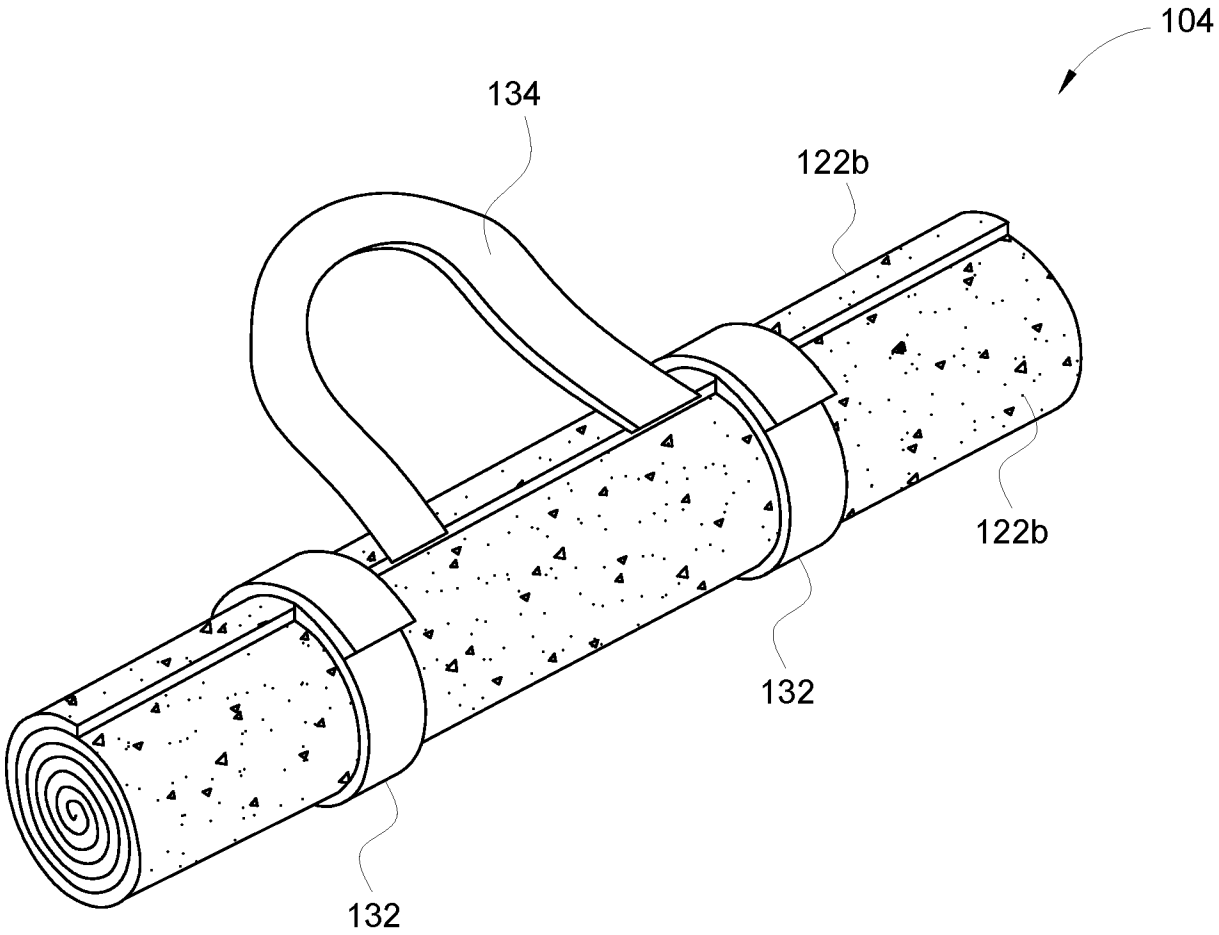
FIG. 11 illustrates a perspective view of the mat in rolled position, in accordance with one or more embodiments of the present disclosure.

Further, in some embodiments, the mat 104 may be adapted to be folded or rolled for portability purposes. FIG. 10 illustrates a perspective view of the mat 104 showing the mat 104 being implemented into a rolled position (about the bottom face 122*a* thereof), in accordance with an embodiment of the present disclosure. FIG. 11 illustrates a perspective view of the mat 104 being completely implemented into the rolled position. In some examples, the mat 104 may include straps 132 which once clasped may help to tighten and maintain the mat 104 in the rolled position. Further, the mat 104 may include a handle 134 which may be used to carry the mat 104 with ease. In one example, the handle 134 may be implemented in the form of a shoulder strap so that the user may hang the rolled mat 104 from his/her shoulder for carrying purposes. It may be understood that more than one mat 134 may be combined and rolled together into a single roll which could then be carried by the user, thus enabling the user to have readily available different varieties of mats 104 while allowing for portability.

Furthermore, in some embodiments, the training device 100 of the present disclosure may include performance monitoring systems (not shown) therein. Such performance monitoring systems may include, for example, sensors (like timing switches) installed on the base 108; so that when the user may be practicing his/her dribbling skills, the training device 100 may be able to measure bounce rates of the ball, force related to each bounce, and similar parameters. These performance monitoring systems may also include a controller or the like which may perform computation on such data and come up with useable statistics for improving user's skills, which is to be displayed to the user by using any known means in the art. In other examples, the controller may simply transmit the data to the user's smartphone, in which an app paired with the training device 100 may receive the sensed data and perform required computations. In some examples, the training device 100 may include plurality of lights (not shown) scattered over the base 108 which may be visible through the mat 104. These lights may pulse in an alternate fashion so that the user may try to aim/target for the active light, thus providing sort of automated instructions to the user for improving dribbling skills.

The training device 100 of the present disclosure may particularly be suitable for its implementation as basketball practicing equipment. The training device 100 with its option to conveniently replace installed mat 104 with any of the available varieties of surfaces may allow the user to simulate practicing his/her skills in different basketball court's environments from the convenience of a single location, say inside the user's bedroom itself. The raised sides 110 of the frame 106 against the base 108 (even after the mat 104 installed thereon) forces the user to dribble within the available training space, which helps to improve ball control. In the present training device 100, the platform 102 being foldable and further the mats 104 being rolled enables the user to carry the whole training device 100 in unassembled form with ease. Further, the training device 100 could be set-up fairly easily without requiring any particular skills. In some examples, it may even be possible to install the training device 100 against a wall or anything vertical, so as to practice ball handling skills by bouncing the ball against the vertical wall.

The present training device 100 is portable, requires minimal space, can and inexpensive to manufacture. Further, the training device 100 may be used can be used for different sports training purposes and is convenient to set-up. It may be understood that the present training device 100 is not limited to practicing basketball skills, and may be employed for practicing any other form of sports which could possibly utilize different surfaces. For example, the training device 100 could be used for practicing tennis serving skills on grass mats (including different types of grass) versus hard mats (including varying hardness of surface), soccer skills on grass mats versus hard mats, golf putting skills, and so on. In other examples, the training device 100 may possibly be used for any activity requiring replacing surfaces therein.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A training device for practicing basketball dribbling, comprising:

a. a frame having raised perimeter sides, said perimeter sides having a height and a topmost and bottommost end;

b. a base having a top surface and a bottom surface, said base is positioned at the midpoint of said height and is entirely within said perimeter sides, a first pocket located at said top surface defined by a first spacing having a first spacing height located between said base and said topmost end of said perimeter sides, said first pocket defining a first inner area, a second pocket located at said bottom surface defined by a second spacing having a second spacing height between said base and said bottommost end of said perimeter sides, said second pocket defining a second inner area, said base is entirely fixed within said frame;

c. a first mat having a first mat width and is positioned within said first pocket and having a thickness equal to the first spacing height, thereby being flush and coplanar with said topmost end of said perimeter sides, said first mat is made of a first material removably mounted to said top surface of said base, said first mat has a bottom side that includes first mat fastening members, said first mat fastening members being a plurality of parallel and horizontal strips of hook and loop fasteners of the same length and width, said first mat fastening members extend entirely along said bottom side of said first mat across said first mat width, said base having first base fastening members on said top surface corresponding with said first mat fastening members of said first mat to removably mount said first mat to said top surface, said first mat being a unitary piece, said first mat filling and extending entirely within said first inner area when mounted to said base within said frame;

d. a second mat having a second mat width and is positioned within said second pocket and having a thickness equal to the second spacing height, thereby being flush and coplanar with said bottommost end of said perimeter sides, said second mat is made of a second material removably mounted to said bottom surface, said second mat has a top side that includes second mat fastening members that extend entirely along said top side of said second mat across said second mat width, said base having second base fastening members on said bottom surface to removably mount said second mat to said bottom surface, said base having a width, said first base fastening members and said second base fastening members being parallel and horizontal strips of hook and loop fasteners that run along the entire width of said base and correspond with the first mat fastening members and said second mat fastening members, respectively said first and second mats being housed entirely within said raised perimeter sides, said first mat and said second mat being of equal said thickness, said second mat being a unitary piece, said second mat filling and extending entirely within said second inner area when mounted to said base within said frame;

e. a ball adapted to be bounced on said first or second mat;

f. said base having a length and a seam located at the midpoint of said length and extending along the base's entire said width used to fold said base in half;

g. said first and second materials are capable of being rolled thereby allowing said first and second mats to be rolled for storage, wherein the first mat includes a strap assembly, said strap assembly includes straps that wrap around a circumference of said first mat in the rolled position, and said strap assembly includes a handle mounted to said first mat;

h. two of said perimeter sides include frame handles in the form of grooves which allow a user to lift one half of said frame about a hinge mechanism mounted on a midpoint of said frame in order to transform said frame from a folded position to an open position or vice-versa; and i. said first mat fastening members, said second mat fastening members, said first base fastening members and said second base fastening members defining horizontal spaces of substantially equal dimensions on said first mat, said second mat and said base, said first mat fastening members, said second mat fastening members, said first base fastening members and said second base fastening members further defining a middle space on each of said first mat, said second mat and said base that is greater in size than the size of remaining said horizontal spaces, said middle space folding in half at the midpoint of said base upon said base being moved to said folded position.

2. The training device for practicing basketball dribbling of claim 1 wherein said frame is defined by a rectangular or square shape.

3. The training device for practicing basketball dribbling of claim 1 wherein said frame has four sides.

4. The training device for practicing basketball dribbling of claim 1 wherein said frame is made of plastic, wood, metal, aluminium, or rubber.

5. The training device for practicing basketball dribbling of claim 1 wherein said base is fixed to said frame using fastening members.

6. The training device for practicing basketball dribbling of claim 5 wherein said fastening members are screws, adhesive, hook and loop fasteners, or nails.

7. The training device for practicing basketball dribbling of claim 1 wherein said frame has corners being curved.

8. The training device for practicing basketball dribbling of claim 1 wherein said frame includes inner edges, said base is disposed in contact with the inner edges of the frame.

9. The training device of claim 1 wherein said base includes sensors adapted to determine a bounce rate and a bounce force of the ball, said sensors connected to a mobile application and said sensors configured to transmit data to said mobile application.

10. The training device of claim 1 wherein said frame includes mounting members configured to mount said device to a vertical surface.

11. The training device of claim 1 wherein said first mat or said second mat are of a grass material.

* * * * *